US011905135B1

(12) United States Patent
Sims

(10) Patent No.: US 11,905,135 B1
(45) Date of Patent: Feb. 20, 2024

(54) YARN FEEDING ASSEMBLY FOR HEAT SETTING APPLICATIONS, AND SYSTEMS AND METHODS OF USING SAME

(71) Applicant: COLUMBIA INSURANCE COMPANY, Omaha, NE (US)

(72) Inventor: Larry B. Sims, Dalton, GA (US)

(73) Assignee: Columbia Insurance Company, Omaha, NE (US)

( * ) Notice: Subject to any disclaimer, the term of this patent is extended or adjusted under 35 U.S.C. 154(b) by 291 days.

(21) Appl. No.: 17/173,982

(22) Filed: Feb. 11, 2021

Related U.S. Application Data

(60) Provisional application No. 62/972,905, filed on Feb. 11, 2020.

(51) Int. Cl.

| | |
|---|---|
| ***B65H 49/16*** | (2006.01) |
| ***D02J 13/00*** | (2006.01) |
| ***D02H 1/00*** | (2006.01) |
| ***D01H 1/18*** | (2006.01) |
| *D06B 3/04* | (2006.01) |

(52) U.S. Cl.
CPC ..... *B65H 49/16* (2013.01); *D01H 1/18* (2013.01); *D02H 1/00* (2013.01); *D02J 13/00* (2013.01); *B65H 2701/31* (2013.01); *D06B 3/04* (2013.01)

(58) Field of Classification Search
CPC ..... B65H 49/16; B65H 2701/32; D02H 1/00
See application file for complete search history.

(56) References Cited

U.S. PATENT DOCUMENTS

| | | | | |
|---|---|---|---|---|
| 4,538,776 A * | 9/1985 | Perry | ..... | B65H 49/16 57/352 |
| 8,177,154 B1 * | 5/2012 | Hoover | ..... | B65H 49/16 242/594.6 |
| 2014/0196264 A1 * | 7/2014 | Boetsch | ..... | D02G 1/125 28/248 |

FOREIGN PATENT DOCUMENTS

| | | | | |
|---|---|---|---|---|
| EP | 2163667 A1 * | 3/2010 | ..... | B65H 63/086 |

OTHER PUBLICATIONS

Machine Translation of EP 2 163 667 A1, Mar. 17, 2010. (Year: 2010).*

* cited by examiner

*Primary Examiner* — William E Dondero
(74) *Attorney, Agent, or Firm* — Ballard Spahr LLP

(57) ABSTRACT

A heat setting apparatus feeding assembly can comprise a yarn package rack having a first side and an opposing second side. A plurality of yarn package engagement elements can be positioned on each of the first side and the second side of the yarn package rack. The yarn package rack can be configured to rotate about a pivotal axis to orient one of the first side or the second side toward a yarn package loading area and to orient the other of the first side and the second side toward a feed direction.

20 Claims, 9 Drawing Sheets

YARN FEEDING ASSEMBLY FOR HEAT SETTING APPLICATIONS, AND SYSTEMS AND METHODS OF USING SAME

CROSS-REFERENCE TO RELATED APPLICATION

This application claims priority to, and the benefit of the filing date of, U.S. Provisional Patent Application No. 62/972,905, filed Feb. 11, 2020, the entirety of which is hereby incorporated by reference herein in its entirety.

FIELD

This disclosure relates to systems, apparatuses, and methods for yarn processing and, in particular, to automated systems for providing yarn to a heat setting apparatus or other yarn processing apparatus.

BACKGROUND

Conventional heat setting machines are fed with yarn packages positioned on a rack, and ends of yarn from the yarn packages are provided to the heat setting machine. The yarn packages are manually positioned on the rack. When the yarn packages are depleted, the heat setting machine has to be stopped (i.e., operation ceased) so that the rack can be replenished with fresh yarn packages. This stoppage, during which workers must manually remove old yarn packages and correctly position new yarn packages, creates significant delays in the overall heat setting process and increases the risk of injury or error.

SUMMARY

Described herein, in various aspects, is a feeding assembly. Optionally, the feeding assembly can provide yarn to a heat setting apparatus. The feeding assembly can comprise a yarn package rack having a first side and an opposing second side. A plurality of yarn package engagement elements can be positioned on each of the first side and the second side of the yarn package rack. The yarn package rack can be configured to rotate about a pivotal axis to orient one of the first side or the second side toward a yarn package loading area and to orient the other of the first side and the second side toward a feed direction.

The feeding assembly can further comprise an actuator that is configured to rotate the yarn package rack about the pivotal axis.

The feeding assembly can further comprise an indicator that is configured to activate prior to pivoting of the yarn package rack.

The indicator can comprise at least one of a light or an audible alarm.

The feeding assembly can comprise eight yarn package engagement elements on each of the first side and the second side of the yarn package rack.

A base can be configured to fixedly mount to a floor, and the yarn package rack can be pivotably coupled to the base.

The yarn package rack can be configured to support at least 680 lbs of yarn packages.

The feeding assembly can further comprise a plurality of yarn packages disposed on respective yarn engagement elements of the plurality of yarn package engagement elements. At least one yarn package of the plurality of yarn packages can comprise a yarn end that extends to a heat setting apparatus.

The feeding assembly can further comprise at least one processor and a memory, wherein the memory has instructions thereon that, when executed by the at least one processor, cause the at least one processor to activate the indicator and cause the yarn package rack to rotate about 180 degrees.

The feeding assembly can further comprise a sensor that is configured to measure a quantity of yarn on a yarn package on a yarn package engagement element.

The feeding assembly can further comprise a user input device, and the user input device can be communicatively coupled to the indicator to permit selective, remote activation of the indicator by an operator of the feeding assembly.

A system can comprise a heat setting apparatus and at least one feeding assembly.

A system can further comprise a loading apparatus that is configured to place packages on the yarn package engagement elements.

The loading apparatus can be a gantry.

The at least one feeding assembly can comprise at least six feeding assemblies.

The at least one heat setting apparatus feeding assembly can comprises at least twelve feeding assemblies.

The system can further comprise at least one processor and a memory, wherein the loading apparatus is positioned within a yarn package loading area. Each feeding assembly of the at least one feeding assembly can comprise: an actuator that is configured to rotate the yarn package rack about the pivotal axis; and an indicator that is configured to activate prior to pivoting of the yarn package rack. The at least one processor can be communicatively coupled to the loading apparatus, the actuator of each feeding assembly, and the indicator of each feeding assembly. The memory can have instructions that, when executed by the at least one processor, cause the at least one processor to: cause the loading apparatus to load a plurality of yarn packages on the first side of a yarn package rack; cause the yarn package rack to rotate about 180 degrees so that the first side of the yarn package rack is oriented in a yarn feed direction and the opposing second side of the yarn package rack is oriented toward the yarn package loading area; and cause the loading apparatus to load a second plurality of yarn packages on the second side of the yarn package rack.

Each feeding assembly can comprise at least one sensor that is configured to measure a quantity of yarn on a yarn package at a yarn package engagement element. The at least one processor can be communicatively coupled to the at least one sensor of each feeding assembly. The memory can have instructions that, when executed by the at least one processor, further cause the at least one processor to: receive signals from the at least one sensor of the feeding assembly of the yarn package rack; activate the indicator based upon the received signals; and cause the yarn package rack to rotate about 180 degrees so that the first side of the yarn package rack is oriented toward the yarn package loading area and the opposing second side of the yarn package rack is oriented in the yarn feed direction.

The at least one feeding assembly can comprise a first feeding assembly and a second feeding assembly. The first feeding assembly can be positioned above or adjacent the second feeding assembly.

Additional advantages of the invention will be set forth in part in the description that follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

DESCRIPTION OF THE DRAWINGS

These and other features of the preferred embodiments of the invention will become more apparent in the detailed description in which reference is made to the appended drawings wherein.

DETAILED DESCRIPTION

Figure 1A:
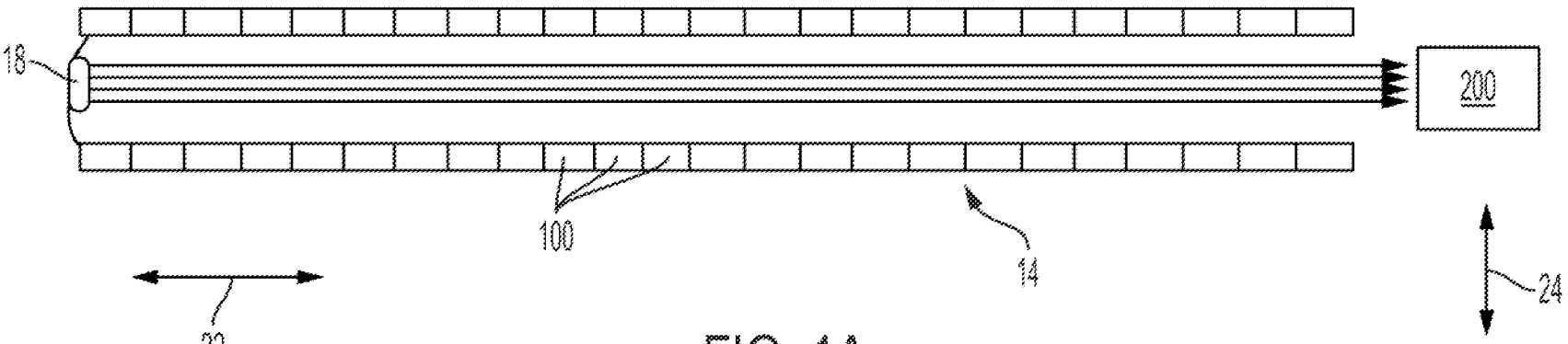
FIG. 1A is an exemplary schematic diagram of a top view of a heat setting system comprising plurality of pivotable yarn package racks, in accordance with embodiments disclosed herein.

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout. It is to be understood that this invention is not limited to the particular methodology and protocols described, as such may vary. It is also to be understood that the terminology used herein is for the purpose of describing particular embodiments only, and is not intended to limit the scope of the present invention.

Many modifications and other embodiments of the invention set forth herein will come to mind to one skilled in the art to which the invention pertains having the benefit of the teachings presented in the foregoing description and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

As used herein the singular forms "a," "an," and "the" include plural referents unless the context clearly dictates otherwise. For example, use of the term "a package" can refer to one or more of such packages, and so forth.

All technical and scientific terms used herein have the same meaning as commonly understood to one of ordinary skill in the art to which this invention belongs unless clearly indicated otherwise.

As used herein, the terms "optional" or "optionally" mean that the subsequently described event or circumstance may or may not occur, and that the description includes instances where said event or circumstance occurs and instances where it does not.

As used herein, the term "at least one of" is intended to be synonymous with "one or more of." For example, "at least one of A, B and C" explicitly includes only A, only B, only C, and combinations of each.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint. Optionally, in some aspects, when values are approximated by use of the antecedent "about," it is contemplated that values within up to 15%, up to 10%, up to 5%, or up to 1% (above or below) of the particularly stated value can be included within the scope of those aspects. Similarly, use of "substantially" (e.g., "substantially parallel") or "generally" (e.g., "generally planar") should be understood to include embodiments in which angles are within about ten degrees, or within five degrees, or within one degree.

The word "or" as used herein means any one member of a particular list and also includes any combination of members of that list.

It is to be understood that unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that an order be inferred, in any respect. This holds for any possible non-express basis for interpretation, including: matters of logic with respect to arrangement of steps or operational flow; plain meaning derived from grammatical organization or punctuation; and the number or type of aspects described in the specification.

The following description supplies specific details in order to provide a thorough understanding. Nevertheless, the skilled artisan would understand that the apparatus, system, and associated methods of using the apparatus can be implemented and used without employing these specific details. Indeed, the apparatus, system, and associated methods can be placed into practice by modifying the illustrated apparatus, system, and associated methods and can be used in conjunction with any other apparatus and techniques conventionally used in the industry.

Figure 1B:
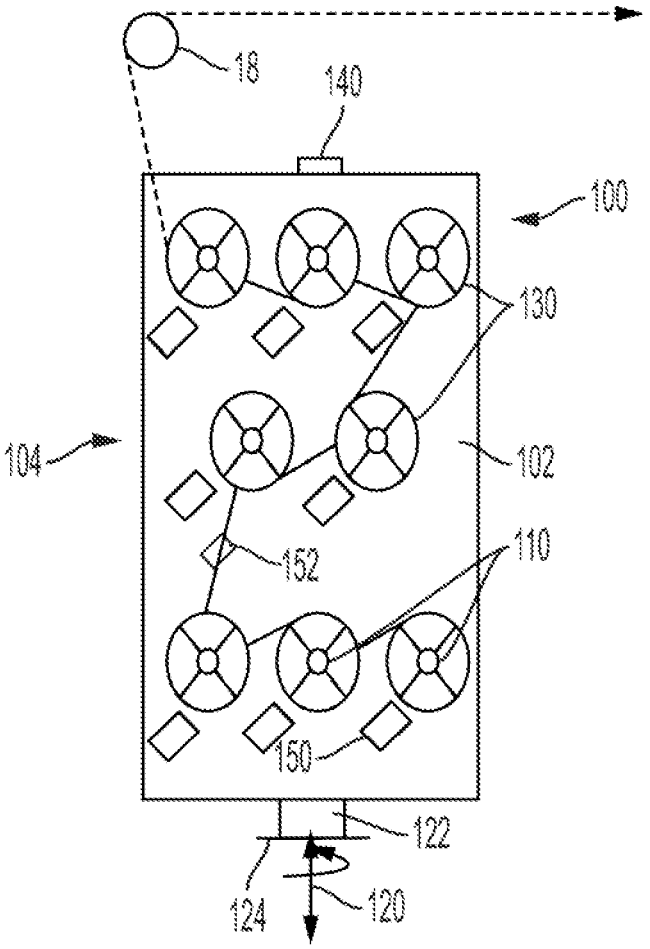
FIG. 1B is a detailed schematic view of a front view of one pivotable yarn package rack as in FIG. 1A.
Figure 2:
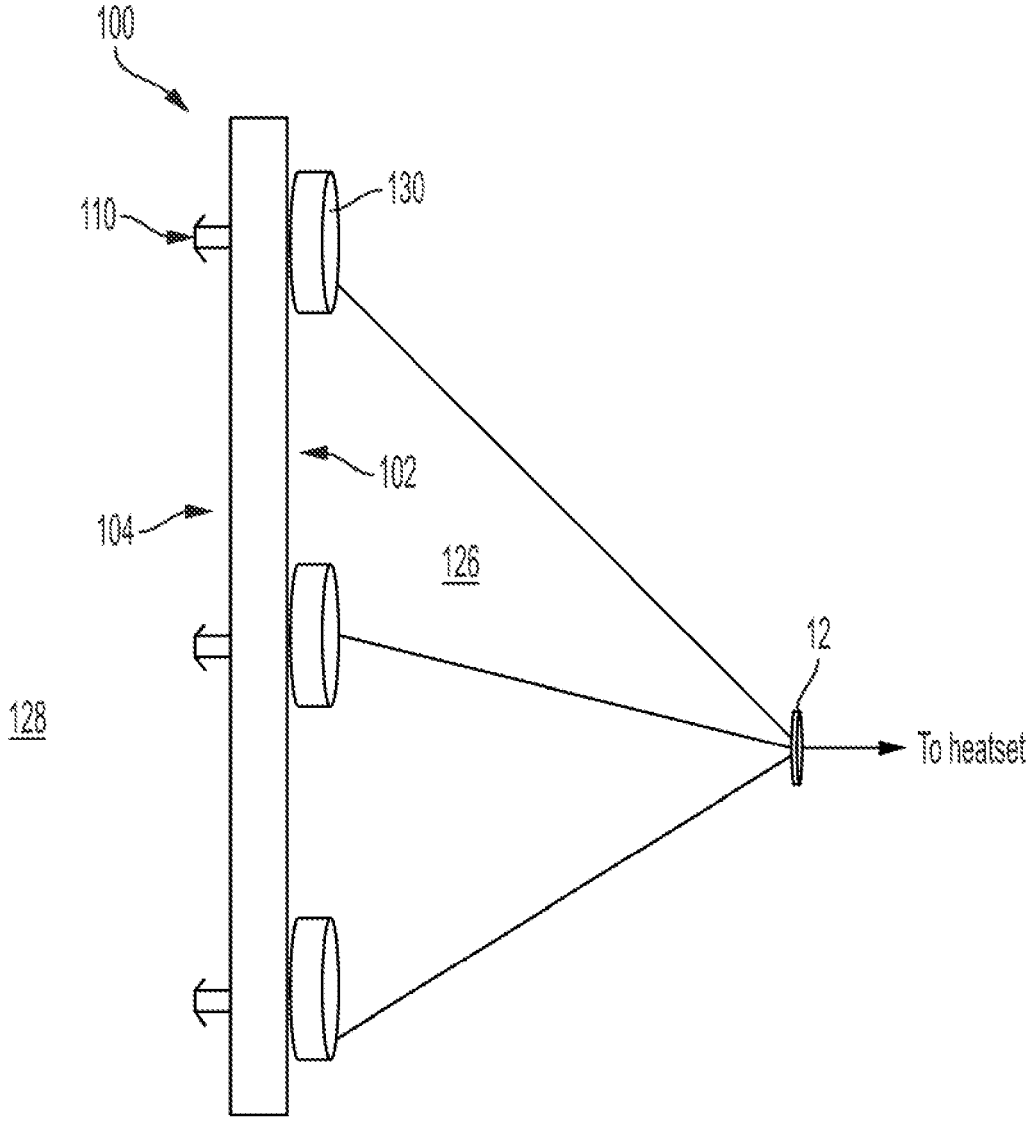
FIG. 2 is a side schematic view of the pivotable yarn package rack of FIG. 1.
Figure 3:
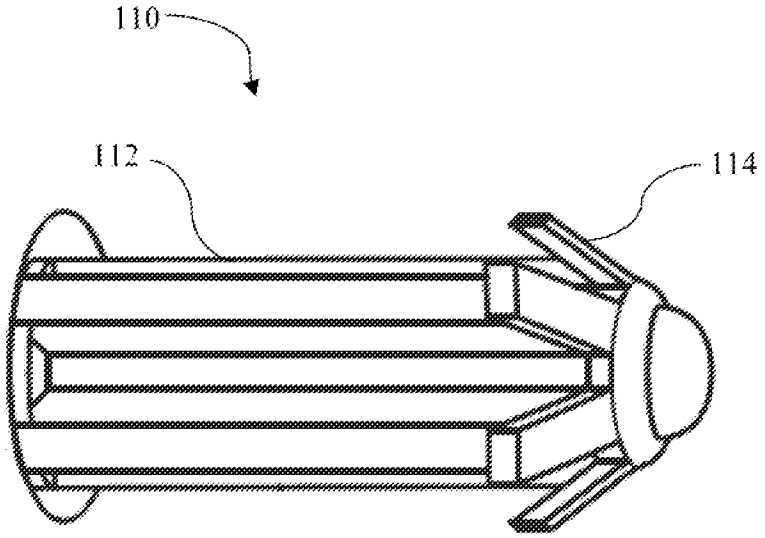
FIG. 3 is side perspective view of a yarn engagement element for the pivotable yarn package rack of FIG. 1.

Disclosed herein, in various aspects and with reference to FIGS. 1-2, is a heat setting system 10. The system 10 can comprise one or more pivotable racks 100 (e.g., yarn package racks) arranged to form a creel 14, and a heat setting apparatus 200, such as a heat setting machine or apparatus as is known in the art, including, for example and without limitation, a machine that is capable of performing a Power- Heat-Set process (with superheated steam/airmix, also known as a Suessen process) or a SUPE RBA TVP3 process (using saturated steam). As used herein, the term "rack" refers to a structure or framework that holds, stores, and/or engages yarn packages as further disclosed herein. In use, the pivotable racks 100 can serve as feeding assemblies for the heat setting machine. Each pivotable rack 100 can have a first side 102 and an opposing second side 104. Each side can optionally be generally planar and vertically oriented. A plurality of yarn package engagement elements 110 can be positioned on each side of the pivotable rack 100. For example, as shown, each side can have eight yarn package engagement elements 110. However, it is contemplated that any desired number of engagement elements can be used on each side (with equal numbers on each side). As shown in FIG. 3, each yarn package engagement element can comprise an elongate body 112 and a retainer 114 that is configured to retain the yarn packages on the respective yarn package engagement elements 110. Optionally, the retainer 114 can be a portion that extends radially outwardly with respect to the elongate body. In further aspects, the retainer 114 can be positioned at a distal end of the elongate body 112 and configured to spring outwardly to releasably retain the yarn package on the yarn package engagement element (for example, after the distal end of the elongate body protrudes through the central opening of a yarn package). In use, it is contemplated that the central opening of a yarn package can be aligned with a corresponding yarn package engagement element and then advanced until the yarn package engagement element is sufficiently received within the central opening of the yarn package to provide engagement with the retainer. Although particular examples of yarn package engagement elements are described herein, it is contemplated that any conventional bullhorn or other structure for engaging yarn packages can be used. In some aspects, the yarn on the yarn packages can comprise or consist of single yarns. In other aspects, the yarn on the yarn packages can comprise or consist of twisted yarns. Although embodiments herein are described as providing yarn to a heat setting apparatus, it is contemplated that the apparatuses, systems, and methods herein can be used to provide yarn to other yarn processing systems and apparatuses, such as, for example, a tufting apparatus for carpet, turf, or other textile manufacturing. Accordingly, unless otherwise indicated, the use of such other yarn processing apparatuses with the disclosed apparatuses and systems is within the scope of this disclosure.

The pivotable rack 100 can be pivotable about a pivotal axis 120. For example, the pivotable rack 100 can be supported by one or more bearings (optionally, supported from above and below). Optionally, the pivotable rack 100 can comprise an actuator 122 (e.g., a motor, an electric actuator, a pneumatic actuator, a hydraulic actuator, and the like) that is configured to rotate the rack 100 about its pivotal axis 120. In exemplary aspects, the actuator 122 can be a stepper motor, a servo motor, a fluid-power (e.g. vacuum) actuator, or combinations thereof. Optionally, the pivotable rack can be pivotable about a base 124 that can be fixedly mounted to the floor (e.g., via bolts or other fasteners). In further optional aspects, the rack 100 can be configured to be manually pivoted by an operator. By sequentially pivoting 180 degrees (or about 180 degrees), the pivotable rack can alternatingly position one of the first side 102 or the second side 104 in an orientation facing a yarn feed side 126, while positioning the other of the first side 102 and the second side 104 in an orientation facing a yarn package loading area 128 that is opposite the yarn feed side. In some embodiments, the rack can rotate in a single direction. In further embodiments, the rack can alternate rotation direction to pivot back and forth. It is contemplated that the engagement elements can be arranged on the first and second sides 102, 104 such that the positioning of the engagement elements on the first side when the first side faces the yarn feed side 126 is the same, generally the same, or about the same as the positioning of the engagement elements on the second side when the second side faces the yarn feed side.

Figure 4:
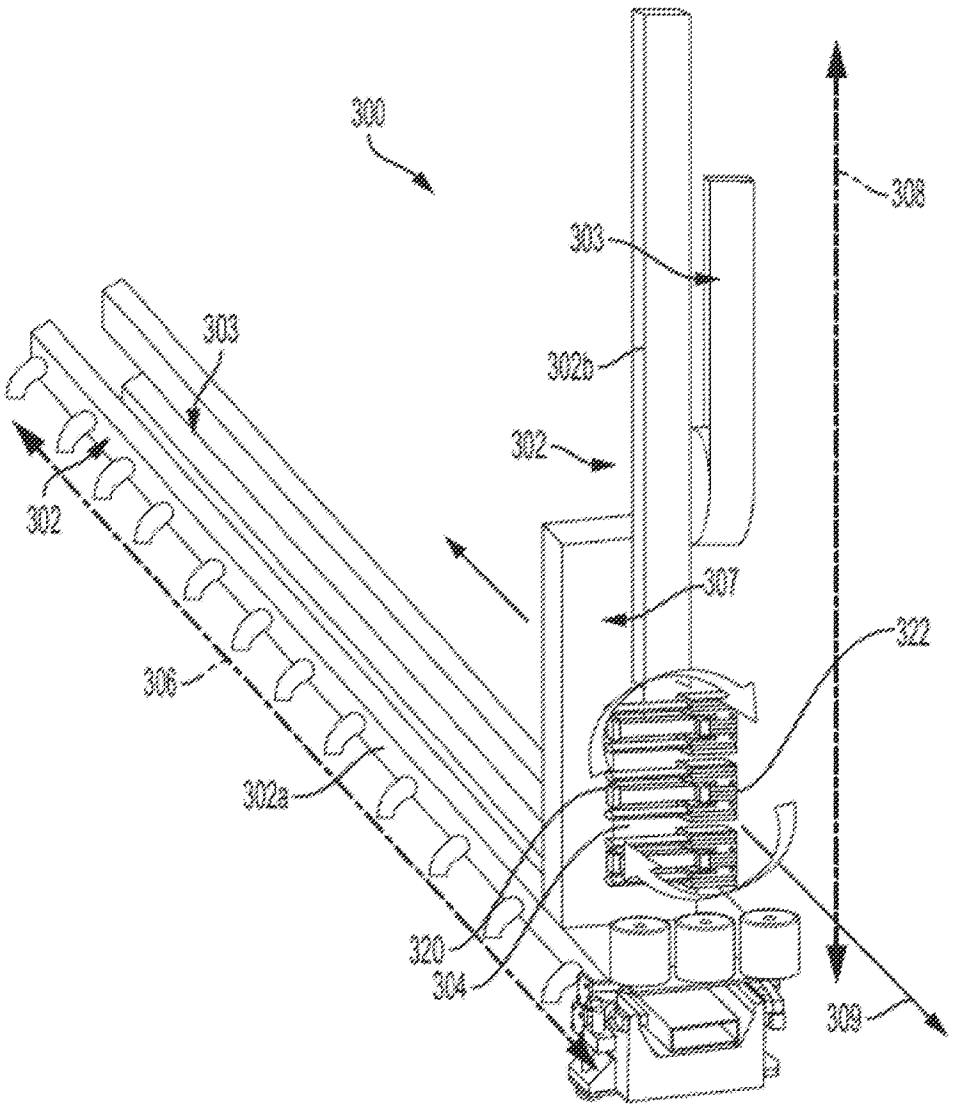
FIG. 4 is a perspective view of a loading device for use with the heat setting system of FIG. 1.

The yarn package loading area 128 can be accessible by an operator or by a loading apparatus. Optionally, the loading apparatus can be a gantry that an operator manually controls. In further aspects, the loading apparatus can be an automated loading apparatus. According to some optional aspects, as shown in FIG. 4, the loading apparatus can comprise, for example, a gantry 300 comprising a frame 302. The frame 302 can comprise a horizontal track 302*a* and a mast 302*b* that is movable via a motor (e.g., a servo motor) on the horizontal track 302*a* along a first axis 306. The frame 302 can include integrated conduits 303 for providing power, air, and a vacuum source. A platform 304 can comprise a first portion that moves vertically, via a motor (e.g., a servo motor), along the mast 302*b*. Thus, the platform 304 can be movable along the frame relative to the first axis 306 and a second (vertical) axis 308, which can be perpendicular or substantially perpendicular to the first axis. The platform can further comprise a second portion that is rotatable with respect to the first portion about a rotary axis 309 that is parallel or substantially parallel to the first axis 306. A rotary actuator (e.g., a stepper motor, a servo motor, a fluid-power (e.g. vacuum) actuator, or combinations thereof) can be configured to rotate the second portion of the platform 304 about the rotary axis 309. A gantry control panel 307 can attach to the mast 302*b*. The gantry 300 can comprise one or more grippers 322 that are configured to grip yarn packages. Optionally, the gripper 322 can comprise a portion that is at least partially receivable into an inner surface of a yarn package 130. The gripper 322 can optionally comprise one or more jaws that extend radially outwardly (relative to the central axis of the yarn package) in order to grip an inner surface of a yarn package 130. One or more actuators 320 can be configured to extend the grippers 322 transversely to the first axis 306 to position yarn packages 130 on (or gripped by) yarn package grippers 322 at respective yarn package engagement elements 110 (FIG. 3). The actuators 320 can comprise pneumatic pistons and/or stepper motors that extend the grippers 322 to the yarn package engagement elements 110 to place the yarn packages thereon. For example, a pneumatic actuator can extend the respective gripper outwardly, a stepper motors can then enable further fine movement to position the yarn package. In this way, the gantry can load respective yarn packages 130 onto each yarn package engagement element 110 of the pivotable rack 100. In various optional aspects, the movement and operation of the gantry 300 can be controlled (automatically, via manual operator control, or both) by a computing device that can be configured as described herein with reference to the computing device 1001. Some further aspects of a gantry that can load packages onto the pivotable rack 100 are described in U.S. patent application Ser. No. 16/526,595, filed Jul. 30, 2019, the entirety of which is hereby incorporated by reference herein.

Figure 8:
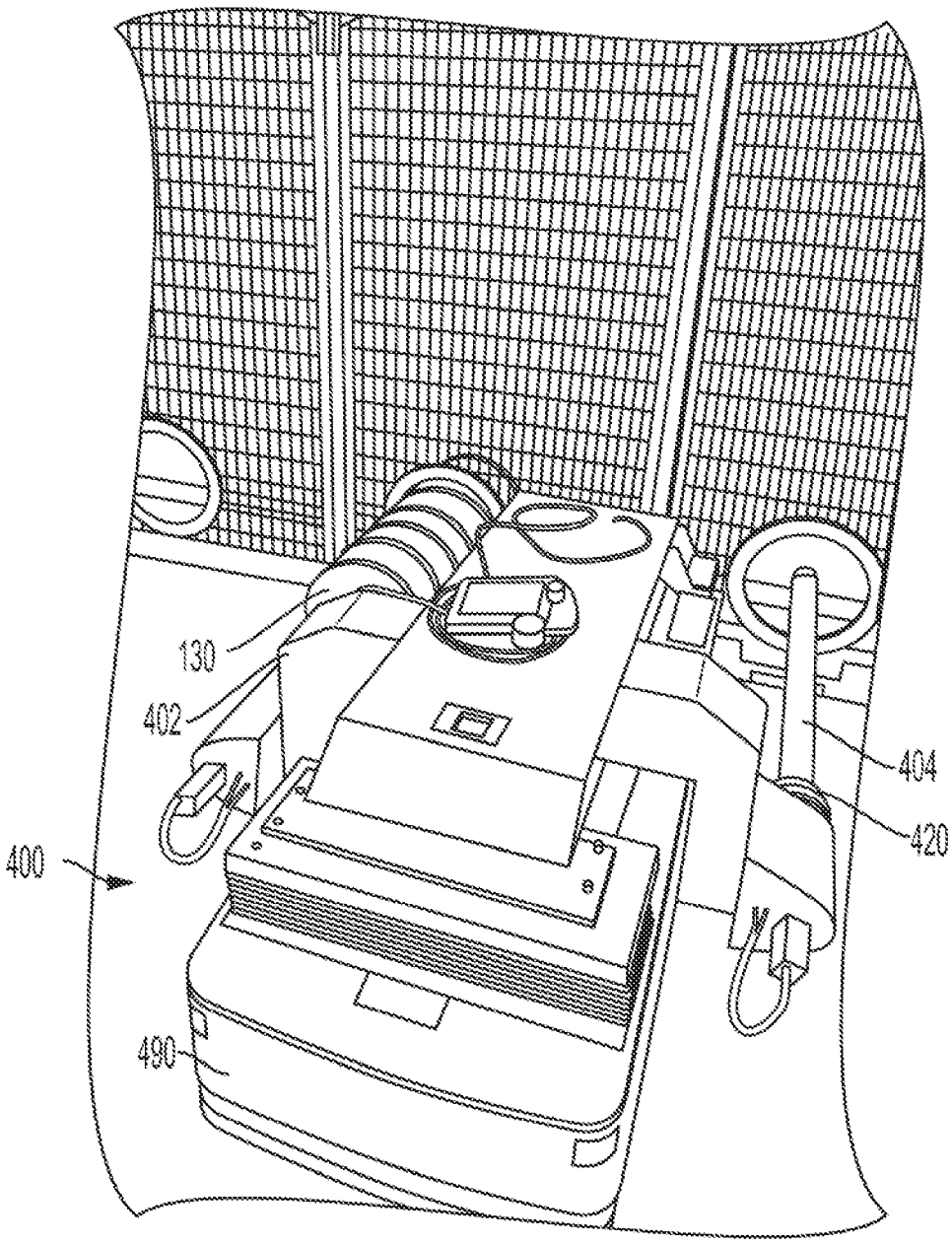
FIG. 8 is a perspective view of an exemplary loading system for providing yarn packages to the pivotable yarn package rack as disclosed herein.

Referring to FIG. 8, in further optional aspects, the automated loading apparatus can comprise a loading system 400 comprising an automated guided vehicle (AGV) 490 and a loading assembly 402 coupled thereto that can carry and align packages 130 with respective package engagement elements 110 (FIG. 3). The loading assembly 402 can comprise one or more arms 404 that are configured to receive yarn packages 130. A driver 420 can move distally along the arm 404 to push the packages 130 therefrom and onto respective package engagement elements 110. The loading system 400 can comprise alignment systems (e.g., laser aligners) for aligning the arms 404 with the package engagement elements 110. One or more computing systems can control various aspects of the movement of the loading system 400 including setting its destination and effecting its delivery of yarn packages at the destination. For example, in some optional aspects, a first computing device, which can optionally be configured as disclosed herein with reference to the computing device 1001, can be on-board the loading system 400, and a second computing device (which can optionally be configured as disclosed herein with reference to the computing device 1001) that is in communication with the first computing device on-board the loading system 400 can provide instructions destination and schedule instructions to the first computing device. The computing system can further be in communication with the alignment system to receive information concerning alignment between respective arms 404 and package engagement elements 110. The computing system can further use the information received from the alignment system to determine the appropriate time to deliver the yarn packages to their destinations. Such automated loading systems are disclosed in U.S. patent application Ser. No. 17/085,021, filed Oct. 30, 2020, the entirety of which is hereby incorporated by reference herein.

In some optional aspects, an automated guided vehicle (e.g., AGV 490) can be configured to lift and move the pivotable racks 100. Accordingly, in some aspects, the AGV can be configured to position an empty pivotable rack 100 in position for loading with yarn packages. Optionally, for example, the AGV can position the empty pivotable rack 100 adjacent to the gantry 300. The gantry 300 can then position packages on the package engagement elements of the first side 102 of the pivotable rack 100. The pivotable rack 100 can then pivot 180 degrees to expose the second side 104 to the gantry, and the gantry can then load packages on the package engagement elements of the second side. The AGV can then move the pivotable rack 100 to the creel 14.

In some optional aspects, at least a portion of the AGV (or an engagement element that is coupled to the AGV) can be configured to position itself beneath the pivotable rack 100 or otherwise grip and lift the pivotable rack for movement thereof. For example, the base of the pivotable rack can define a receiving space (e.g., slot) into which the AGV can be positioned. The AGV can comprise risers that can move upwardly to engage an underside of the pivotable rack (e.g., a bottom surface of the base) and lift the pivotable rack 100. In this way, the pivotable rack can be lifted and transported via the AGV.

In some aspects, the AGV can comprise an engagement portion (e.g., a lift apparatus, a clamp apparatus, a hook, and the like) that is configured to selectively engage the base of the pivotable rack 100, as further described herein. For example, in one aspect, the AGV can comprise a lift apparatus having at least one engagement element that is configured to partially or fully slide within a receiving space or slot defined by the base of the stalk subassembly. In exemplary aspects, the at least one engagement element of the lift apparatus can comprise an arm (or a plurality of arms), a panel, a platform, a gripper (or a plurality of grippers), or the like. In further exemplary aspects, the lift apparatus can further comprise an actuator that is communicatively coupled (through a wired or wireless connection) to the at least one engagement element and that is configured to effect selective movement of the lift apparatus relative to at least a vertical axis. Optionally, in these aspects, it is contemplated that the actuator can be configured to effect selective movement of the at least one engagement element relative to at least one additional axis (other than the vertical axis), such as, for example, an axis that is perpendicular to the vertical axis (optionally, an axis that extends in a forward direction relative to a front (leading) surface of an automated guided vehicle), thereby assisting with positioning of the at least one engagement element within the receiving space of the base of the pivotable rack. It is contemplated that the actuator can be a linear actuator, such as, for example and without limitation, a mechanical linear actuator, an electromechanical linear actuator, a hydraulic linear actuator, a pneumatic linear actuator, and the like. In use, after at least a portion of the at least one engagement element is received within the receiving space or slot defined by the base portion of the pivotable rack, the actuator can be activated to move the at least one engagement element in an upward direction to engage a portion of the base portion of the pivotable rack and apply a lifting force to the pivotable rack. Following lifting of the pivotable rack to provide sufficient clearance between the base portion of the pivotable rack and the flooring surface, the automated guided vehicle can retain the pivotable rack in the elevated position while the automated guided vehicle moves toward the selected operative position for the pivotable rack. When the automated guided vehicle arrives at the delivery position proximate the selected operative position, the actuator can be instructed (by a processor) to lower the at least one engagement element until the base portion of the pivotable rack contacts the floor surface in the selected operative position. The at least one engagement element can then be disengaged from the base portion of the pivotable rack through: movement of the at least one engagement element relative to the vertical axis (effected by the actuator); movement of the at least one engagement element relative to an axis that is perpendicular to the vertical axis (effected by the actuator); or movement of automated guided vehicle (causing a corresponding movement of the at least one engagement element); or combinations thereof.

It is contemplated that the AGV can comprise at least one processor (e.g., a controller) that is configured to control movement of the AGV. In some aspects, it is contemplated that processor of the AGV can be embodied as a portion of a computing device as described in accordance with the computing device 1001, further disclosed herein. In various aspects, the processor of the AGV can be in control of a network, further disclosed herein, that can further control movement and operation of the AGV (e.g., providing destination instructions, instructions for tasks to be perform at a given destination, etc.).

Although particular examples of automated loading apparatuses are disclosed herein, it is contemplated that any robotic and/or automated apparatus that is configured to transport, engage, position, and/or release yarn packages can be used. In exemplary aspects, it is contemplated that suitable loading apparatuses can have a yarn package engagement structure that is configured to selectively engage and release a selected yarn package, as well as an actuator that is coupled to the yarn package engagement structure such that the actuator can effect selected movement of the yarn package engagement structure (and any yarn package engaged by the yarn package engagement structure). Such automated loading apparatuses can further comprise on-board and/or remote processing circuitry that is communicatively coupled to the yarn package engagement structure and/or the actuator to selectively control engagement, positioning, and release of a yarn package.

In further aspects, packages can be manually positioned on the package engagement elements of the rack. For example, a manually operated lift can be used to raise packages into position with respect to the package engagement elements.

The pivotable rack 100 can comprise a sensor 150 at each yarn package engagement element that can determine an amount of (or the presence of) yarn remaining on each package. The sensor can comprise, for example, a camera that can measure the diameter of the yarn package, wherein the diameter of the yarn package can correspond to the amount of yarn remaining on the package. In this way, the pivotable rack 100 can determine when the yarn packages on the feed side of the rack are empty or soon to be empty. Other examples of sensor 150 include, for example and without limitation, capacitive sensors, laser-based sensors, photoelectric sensors, rotary encoders, ultrasonic gauge sensors, and other sensors that are suitable for measuring a diameter of a yarn package or estimating a remaining quantity of yarn on the yarn package. Optionally, when a camera is used, it is contemplated that the processing components of the system as further disclosed herein can make use of machine vision techniques to monitor and determine changes in the diameter of a yarn package. Additionally, or alternatively, such sensors can comprise optical sensors that are well known in the art.

Upon a condition (e.g., determining via sensor 150 that the quantity of yarn remaining on a package is below a threshold or receiving instructions from an operator), the pivotable rack 100 can be configured to activate an indicator 140 that can indicate that the pivotable rack 100 is about to rotate or that the pivotable rack 100 needs to be rotated. In some aspects, the condition can be a determination via sensor 150 that the quantity of yarn remaining on a yarn package is below a threshold or that there is no yarn present on a yarn package. In additional aspects, the condition can be a receipt of instructions from an operator who observes a quantity of yarn on a given yarn package or receives a separate indication of a quantity of yarn on the yarn package. Thus, in use, it is contemplated that the indicator can be activated in either an automated or a manual fashion.

Figure 7:
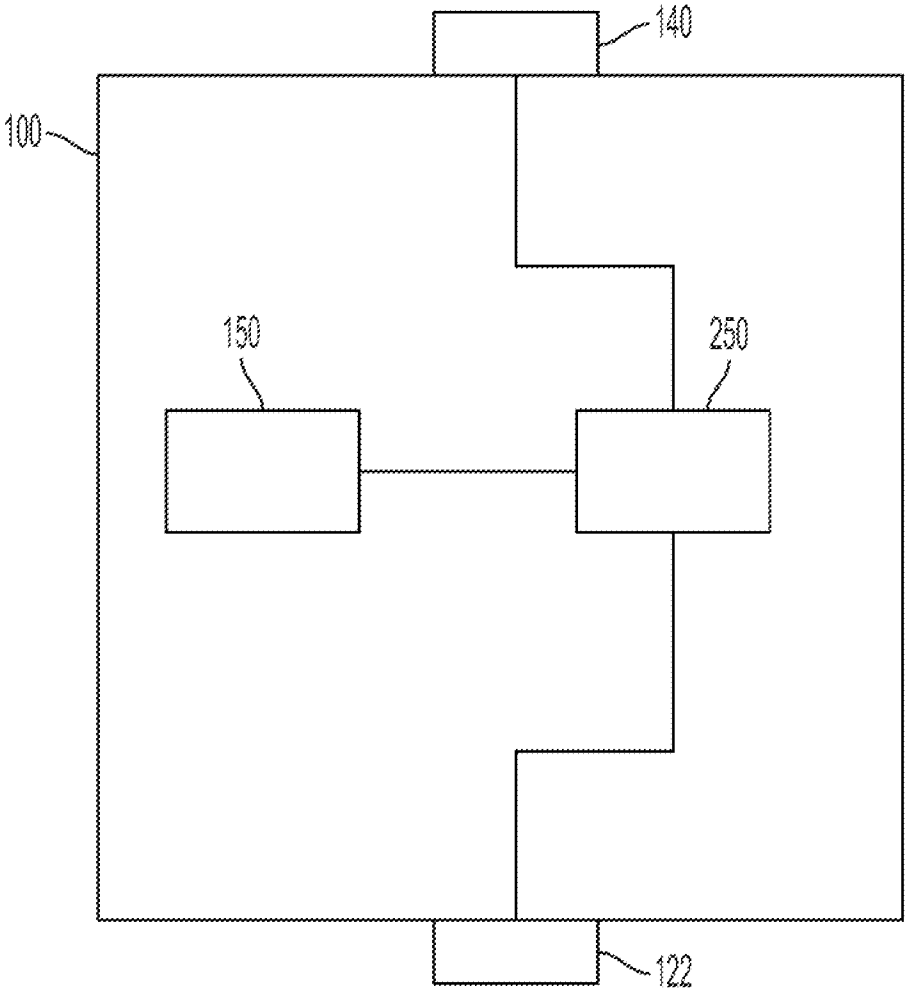
FIG. 7 is a block diagram of an exemplary system comprising an on-board controller. Optionally, the on-board controller can enable automatic control (e.g., automatic rotation) of the pivotable yarn package rack.

For example, referring to FIG. 7, the indicator 140 can automatically be activated when the sensor 150 detects an amount of yarn on a package that is less than a threshold (or determines that there is no yarn (or substantially no yarn) remaining on a package. In some optional aspects, the sensor 150 can be in communication with a processor (e.g., a controller 250 that can optionally be disposed on the rack) that is configured to receive a signal from the sensor. In exemplary aspects, the processor can determine, based on the signal from the sensor, when the yarn is below a threshold. In response to determining that the yarn is below the threshold, the processor can be configured to cause the indicator 140 to activate. In various optional aspects, the processor can be a portion of a computing device that can be configured as described with reference to the computing device 1001, further disclosed herein.

Figure 6:
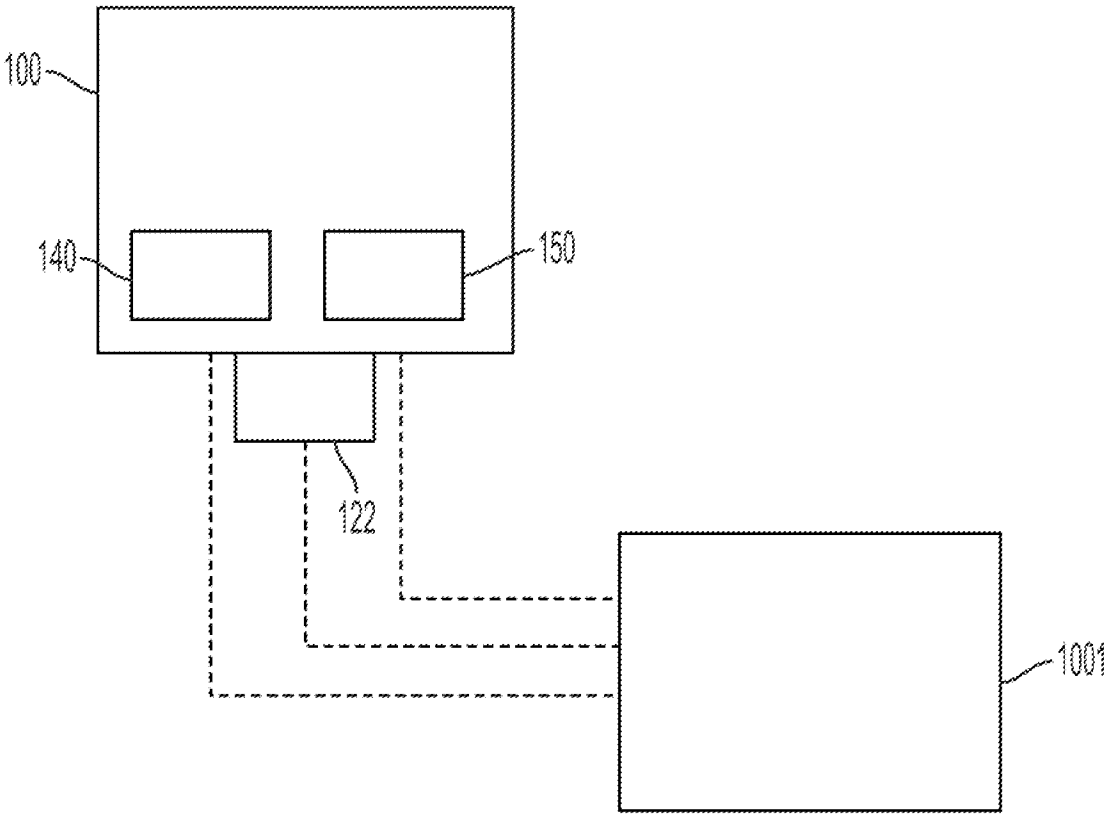
FIG. 6 is a block diagram of an exemplary system controlling rotation of the pivotable yarn package rack with a remote computing device. Optionally, the remote computing device can provide a user interface for manual control of the pivotable yarn rack (e.g., rotation of the rack).

Referring to FIG. 6, in some optional aspects, a computing device 1001, as further described herein, can provide an interface to the operator. The computing device 1001 can optionally be remote of the pivotable rack 100. The computing device 1001 can enable an operator to cause the pivotable rack 100 to rotate. For example, the computing device 1001 can have a button or touchscreen interface that sends a signal to the actuator 122 to cause the pivotable rack to rotate. In various further aspects, the computing device can comprise any suitable input device (e.g., a button portion of a touchscreen, dial, switch, knob, voice-activated controller, etc.) that, when pressed, engaged, or otherwise activated, can send a signal to the actuator to cause the actuator to rotate. The computing device 1001 can further be in communication with the sensor 150. In this way, the sensor 150 can inform the operator, through the computing device 1001, that the yarn on a yarn package, or a side of the pivotable rack, is below a threshold. The operator can then determine when to manually (via the remote computing device 1001) cause the pivotable rack to rotate.

The indicator 150 can comprise, for example, a visible alarm (e.g., a light), an audible alarm, and/or a signal that is provided to a computer (or other computing device, such as, for example, the computing device 1001 or another computing device so configured), which can optionally be located in a control room. When the pivotable rack 100 receives a signal to rotate (e.g., from the controller 250 in response to a signal from the sensor 150 or the computing device 1001 receiving an input from an operator), it is contemplated that pivoting of the rack can be delayed for a minimum period of time (following activation of the indicator) to warn operators that movement of the pivotable rack is about to begin. In various optional aspects, the minimum time period can be, for example, 5 seconds, 10 seconds, 20 seconds, 30 seconds, one minute, or any suitable time to allow operators to clear the area. After at least the minimum period of time, the pivotable rack 100 can rotate to expose the loaded side of the rack to the feed side and the empty side of the rack to the loading side. In further aspects, it is contemplated that the area in which the pivotable racks 100 are positioned is a restricted area that cannot be entered without locking out or shutting down the system. Thus, in these aspects, it is contemplated that the minimum time period can be reduced or eliminated. For example, in some aspects where operators are not present in the area of the pivotable racks, it is contemplated that the movement of the racks can begin as soon as the pivotable rack receives the signal to rotate (without the need for a delay period).

Alternatively, the pivotable rack 100 can be configured to rotate in response to a manual user input after activation of the indicator 140. In this alternative configuration, the indicator 140 can be activated to indicate that the pivotable rack 100 needs to be rotated to provide fresh yarn packages for feeding of the heat setting apparatus, and a separate input can be provided to effect the rotation of the pivotable rack 100 at a selected time. The separate, manual user input can be provided using a user input device, such as, for example and without limitation, a computing device (e.g., a tablet or computer), a remote control, a smartphone, a keyboard, a mouse, a touchscreen display, a microphone (through verbal control), and the like.

Optionally, the heat setting apparatus 200 can be, for example, a SUPERBA heat setting apparatus or a Suessen heat setting apparatus. Optionally, 36-96 yarn ends can be fed at a single time to the heat setting apparatus 200. For example, a SUPERBA heat setting apparatus can optionally receive 48-96 yarn ends. Optionally, a Suessen heat setting apparatus can receive 96 yarn ends. As one of ordinary skill in the art will appreciate, the heat setting apparatus 200, which operates at high temperature, can be used to develop and achieve a desired volume of a yarn and to ensure that the new properties obtained from yarn twisting remain permanent in downstream products, such as carpets and other floor coverings. Thus, as used herein, it is contemplated that the heat setting apparatus 200 can include, for example, one or more of the following components as are known in the art: a texturization device; a yarn bulking device; a heat setting tunnel; and a winder (that receives the heat-set yarn).

In some aspects and as shown in FIG. 1, the racks can be arranged in rows of two opposing racks, and the rows of racks can be arranged along a longitudinal dimension 22 of the creel. For example, FIG. 1 shows forty-eight racks arranged in twenty-four rows of two racks. According to some aspects, one or more pivotable racks 100 can be vertically positioned with respect to each other (e.g., stacked on top of each other). That is, a first pivotable rack can be stacked on top of a second pivotable rack. For example, each row can comprise opposing pairs of stacked pivotable racks (one stack of pivotable racks on each side of the creel in a horizontal dimension that is transverse to the longitudinal dimension 22 of the creel), wherein each pair of stacked racks has a lower rack and an upper rack above each lower rack. In this way, the length of the creel in the longitudinal dimension 22 can be reduced (e.g., approximately halved). Thus, a creel comprising forty-eight racks can optionally comprise twelve rows of opposing pairs of pivotable rack stacks, each stack having a lower rack and an upper rack, wherein the opposing pairs of pivotable rack stacks are aligned in a longitudinal dimension of the creel. In further aspects, three or more pivotable racks can be stacked on top of each other. Additionally, or alternatively, in other aspects, it is contemplated that one or more pivotable racks 100 can be positioned side-by-side in a horizontal dimension 24 that is transverse to the longitudinal dimension 22 of the creel 14. In some embodiments, the pivotable racks can be staggered to shorten the length of the creel. For example, it is contemplated that every other pivotable rack (moving along the length of the creel) can be offset (from adjacent rows of racks) in a horizontal dimension that is transverse to the longitudinal dimension 22 of the creel.

It is contemplated that sufficient yarn packages can be positioned on a single side of the pivotable rack 100 so that the heat set (e.g., the heat setting apparatus) can run for at least twelve hours. Optionally, each side can have eight yarn package engagement elements, or at least eight engagement elements, or at least ten yarn package engagement elements, or at least twelve yarn package engagement elements, or at least twenty yarn package engagement elements. In further aspects, the pivotable rack can have one yarn package engagement element or two yarn package engagement elements or between three and eight yarn package engagement elements.

It is contemplated that each yarn package, when initially positioned on the pivotable rack, can weigh about forty pounds. Thus, in some exemplary aspects where eight engagement elements are provided on each side of the pivotable rack 100, it is contemplated that the rack can be configured to support sixteen packages having a cumulative weight of 640 pounds. It is further contemplated that the rack can be structurally supported so that it is stable when one side is fully loaded and the opposing side is empty.

Referring to FIGS. 1A-2, yarn from the pivotable rack 100 can extend to a yarn guide 12. FIG. 2 illustrates yarn extending through the yarn guide 12 from different yarn packages in different positions on the yarn guide. The yarn guide 12 can be, for example, a ceramic component defining a hole therethrough that can direct yarn from each yarn package engagement element to a single position. It is contemplated that yarn is not necessarily simultaneously drawn from multiple yarn packages of a single yarn rack at a particular time; rather, this schematic diagram depicts how the yarn can be drawn from a single position (at the yarn guide 12) regardless of which yarn package the yarn is currently being drawn from. The yarn guide 12 can optionally be positioned proximate to or adjacent to the package that it is guiding. Optionally, the yarn guide 12 can guide the yarn directly to the heat setting apparatus 200 (e.g., for a Suessen heat setting apparatus). According to further optional aspects, the yarn can pass around a turnaround roll 18 (e.g., for a SUPERBA heat setting apparatus) that directs the yarn into the heat setting apparatus 200. For example, a plurality of turnaround rolls 18 can be spaced along the longitudinal length of the creel. The turnaround rolls can have respective tensions selected based on their distance from the heat setting apparatus in order to equalize tension among the lengths of yarn at the entry to the heat setting apparatus. In use, the turnaround roll (or rolls) can equalize the tension within each respective yarn (from a respective rack) to account for variations in the lengths of the yarns depending upon the positioning of the associated rack within the creel.

In use, it is contemplated that only a single yarn package 130 from each rack 100 can feed the heat setting apparatus 200 at any given time. Thus, it is contemplated that yarn ends from two yarn packages can be spliced using conventional methods (trailing end of a first yarn package being spliced with the leading end of a second/sequential yarn package) so that as one yarn package is depleted, the next yarn package can provide yarn to the heat setting apparatus 200. Optionally, it is contemplated that a plurality of yarn packages (optionally, all yarn packages) on a side of the rack can be spliced together before any yarn packages have been exhausted, thereby ensuring continuous operation until the last yarn package is fully exhausted. In these aspects, it is contemplated that the sensor 150 can estimate the remaining quantity of yarn on a single package (e.g., the last yarn package of the plurality of spliced packages to be drawn from). In further aspects, a plurality of sensors 150 can be configured to estimate the quantity of yarn remaining on some or all of the yarn packages. In some aspects, each section of yarn extending between spliced packages can be retained by a respective piece (one shown in FIG. 1B) of fastening material 152 (e.g., hook and/or loop fastening material) in order to retain the yarn to avoid tangling, drooping, etc. Optionally, at least a portion of the fastening material can be coupled to the pivotable rack 100. In some exemplary aspects, the fastening material 152 (e.g., hook material) can be secured to the pivotable rack 100, and the sections of yarn extending between sliced packages can be retained by the fastening material. As the yarn from a first yarn package is used up, the yarn from the second, spliced yarn package can be provided to the heat setting apparatus, and the shift from the first yarn package to the second yarn package can cause the yarn to disengage the fastening material.

In exemplary aspects, it is contemplated that a plurality of pivotable racks 100 can be arranged among a plurality of cassettes, which cooperate to define the creel 14. Optionally, each pivotable rack 100 can be associated with a particular cassette. In use, it is contemplated that individual cassettes can be selectively added or removed from the creel to permit adjustment of the size of the creel (and the number of pivotable racks and yarn packages within the creel).

Computing Device

Optionally, one or more computing devices can be configured to control aspects of the system 10, such as, for example, rotation of the pivotable rack 100, activation and deactivation of the indicator 140, measurement and monitoring of remaining yarn on the yarn package engagement elements (e.g., via the sensors 150), operation of the loading apparatus (e.g., the gantry 300), operation of the AGV, and operation of the heat setting apparatus 200. Such controlled aspects can be controlled by separate computing devices (e.g., a first computing device/controller 250 on the pivotable rack 100, a second computing device/controller of the loading apparatus 300, and a third computing device/controller on board the AGV can at least partially control movement and operation). Each of the computing devices (e.g., the first, second, and third computing devices) can optionally be configured in accordance with the computing device 1001 as described herein. In further optional aspects, a master computing system can control some or all of the controlled aspects. For example, a master computing device can direct movement of the AGV 490, control operation of the loading apparatus 300, and control movement and monitoring of the pivotable racks 100. In further aspects, the master computing system can comprise one or more computing devices that are in communication with respective controllers of the AGV 490, the loading apparatus 300, and/or the pivotable rack 100. For example, in some optional aspects, a computing device (or a plurality of computing devices in communication with one another) can control movement of the AGV (e.g., causing the AGVs to deliver empty racks and pick up full racks) as well as controlling operation of the loading apparatus 300 for placing yarn packages on the racks. Each of said computing devices can optionally be configured in accordance with the computing device 1001 as described herein.

Figure 5:
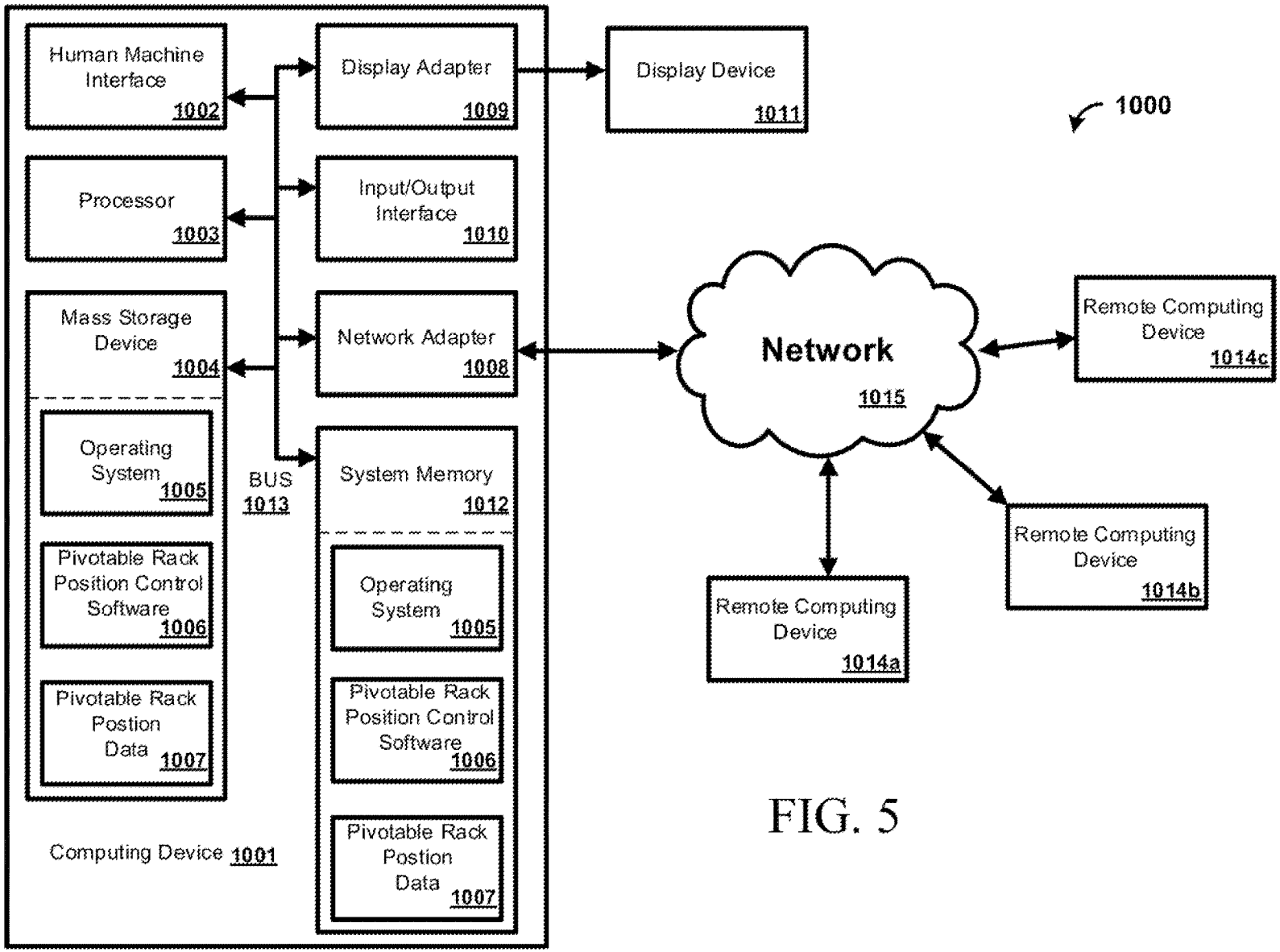
FIG. 5 is a block diagram of an operating environment comprising a computing device for controlling aspects of the heat setting system.

FIG. 5 shows a computing system 1000 including a computing device 1001 for use with the heat setting system 10 as disclosed herein.

The computing device 1001 may comprise one or more processors 1003, a system memory 1012, and a bus 1013 that couples various components of the computing device 1001 including the one or more processors 1003 to the system memory 1012. In the case of multiple processors 1003, the computing device 1001 may utilize parallel computing. In exemplary aspects, the computing device 1001 can comprise a tablet, a smart phone, a personal computer, a laptop computer, or other suitable device (e.g., handheld computing device). It is contemplated that the various computing devices disclosed herein can be configured for wireless communication with other computing devices and circuitry (e.g., sensors) using various protocols, including Internet (WiFi and/or Cloud-based communication), local area network (LAN), Bluetooth (or BLE), Cellular, radio frequency identification (RFID), and the like.

The bus 1013 may comprise one or more of several possible types of bus structures, such as a memory bus, memory controller, a peripheral bus, an accelerated graphics port, and a processor or local bus using any of a variety of bus architectures.

The computing device 1001 may operate on and/or comprise a variety of computer readable media (e.g., non-transitory). Computer readable media may be any available media that is accessible by the computing device 1001 and comprises, non-transitory, volatile and/or non-volatile media, removable and non-removable media. The system memory 1012 has computer readable media in the form of volatile memory, such as random access memory (RAM), and/or non-volatile memory, such as read only memory (ROM). The system memory 1012 may store data such as pivotable rack position data 1007 and/or program modules such as operating system 1005 and pivotable rack position control software 1006 that are accessible to and/or are operated on by the one or more processors 1003.

The computing device 1001 may also comprise other removable/non-removable, volatile/non-volatile computer storage media. The mass storage device 1004 may provide non-volatile storage of computer code, computer readable instructions, data structures, program modules, and other data for the computing device 1001. The mass storage device 1004 may be a hard disk, a removable magnetic disk, a removable optical disk, magnetic cassettes or other magnetic storage devices, flash memory cards, CD-ROM, digital versatile disks (DVD) or other optical storage, random access memories (RAM), read only memories (ROM), electrically erasable programmable read-only memory (EEPROM), and the like.

Any number of program modules may be stored on the mass storage device 1004. An operating system 1005 and pivotable rack position control software 1006 may be stored on the mass storage device 1004. One or more of the operating system 1005 and pivotable rack position control software 1006 (or some combination thereof) may comprise program modules and the pivotable rack position control software 1006. Pivotable rack position data 1007 may also be stored on the mass storage device 1004. Pivotable rack position data 1007 may be stored in any of one or more databases known in the art. The databases may be centralized or distributed across multiple locations within the network 1015.

A user (e.g., the creel operator) may enter commands and information into the computing device 1001 via an input device (not shown). Such input devices comprise, but are not limited to, a keyboard, touchscreen display, pointing device (e.g., a computer mouse, remote control), a microphone, a joystick, a scanner, tactile input devices such as gloves, and other body coverings, motion sensor, and the like. These and other input devices may be connected to the one or more processors 1003 via a human machine interface 1002 that is coupled to the bus 1013, but may be connected by other interface and bus structures, such as a parallel port, game port, an IEEE 1394 Port (also known as a Firewire port), a serial port, network adapter 1008, and/or a universal serial bus (USB).

A display device 1011 may also be connected to the bus 1013 via an interface, such as a display adapter 1009. It is contemplated that the computing device 1001 may have more than one display adapter 1009 and the computing device 1001 may have more than one display device 1011. A display device 1011 may be a monitor, an LCD (Liquid Crystal Display), light emitting diode (LED) display, television, smart lens, smart glass, and or a projector. In addition to the display device 1011, other output peripheral devices may comprise components such as speakers (not shown) and a printer (not shown) which may be connected to the computing device 1001 via Input/Output Interface 1010. Any step and/or result of the methods may be output (or caused to be output) in any form to an output device. Such output may be any form of visual representation, including, but not limited to, textual, graphical, animation, audio, tactile, and the like. The display 1011 and computing device 1001 may be part of one device, or separate devices.

The computing device 1001 may operate in a networked environment using logical connections to one or more remote computing devices 1014*a,b,c*. A remote computing device 1014*a,b,c* may be a personal computer, computing station (e.g., workstation), portable computer (e.g., laptop, mobile phone, tablet device), smart device (e.g., smartphone, smart watch, activity tracker, smart apparel, smart accessory), security and/or monitoring device, a server, a router, a network computer, a peer device, edge device or other common network node, and so on. Logical connections between the computing device 1001 and a remote computing device 1014*a,b,c* may be made via a network 1015, such as a local area network (LAN) and/or a general wide area network (WAN). Such network connections may be through a network adapter 1008. A network adapter 1008 may be implemented in both wired and wireless environments. Such networking environments are conventional and commonplace in dwellings, offices, enterprise-wide computer networks, intranets, and the Internet.

Application programs and other executable program components such as the operating system 1005 are shown herein as discrete blocks, although it is recognized that such programs and components may reside at various times in different storage components of the computing device 1001, and are executed by the one or more processors 1003 of the computing device 1001. An implementation of pivotable rack position control software 1006 may be stored on or sent across some form of computer readable media. Any of the disclosed methods may be performed by processor-executable instructions embodied on computer readable media.

In some embodiments, a single computing device 1001 can control the various processes, databases, and mechanical components of the system 10. For example, in some embodiments, a computing device 1001 can control each of the position of the pivotable rack, activation of the indicator, and operation of the gantry. In other embodiments, a plurality of computing devices can cooperate to control various components of the creel. For example, a first computing device can control the gantry 300 (FIG. 4), a second computing device can control the actuator 122 (FIG. 1) that pivots the pivotable rack, and a third computing device can control activation of the indicator (FIG. 1). Further, the third computing device can interface with the first computing device and second computing device to coordinate various operations of the gantry 300 and the pivotable rack 100.

EXEMPLARY ASPECTS

In view of the described products, systems, and methods and variations thereof, herein below are described certain more particularly described aspects of the invention. These particularly recited aspects should not however be interpreted to have any limiting effect on any different claims containing different or more general teachings described herein, or that the "particular" aspects are somehow limited in some way other than the inherent meanings of the language literally used therein.

Aspect 1: A feeding assembly comprising: a yarn package rack having a first side and an opposing second side; and a plurality of yarn package engagement elements on each of the first side and the second side of the yarn package rack, wherein the yarn package rack is configured to rotate about a pivotal axis to orient one of the first side or the second side toward a yarn package loading area and to orient the other of the first side and the second side toward a feed direction.

Aspect 2: The feeding assembly of aspect 1, further comprising an actuator that is configured to rotate the yarn package rack about the pivotal axis.

Aspect 3: The feeding assembly of aspect 1 or aspect 2, further comprising an indicator that is configured to activate prior to pivoting of the yarn package rack.

Aspect 4: The feeding assembly of aspect 3, wherein the indicator comprises at least one of a light or an audible alarm.

Aspect 5: The feeding assembly of any one of the preceding aspects, wherein the plurality of yarn package engagement elements comprises eight yarn package engagement elements on each of the first side and the second side of the yarn package rack.

Aspect 6: The feeding assembly of any one of the preceding aspects, further comprising a base that is configured to fixedly mount to a floor, wherein the yarn package rack is pivotably coupled to the base.

Aspect 7: The feeding assembly of any one of the preceding aspects, wherein the yarn package rack is configured to support at least 680 lbs of yarn packages.

Aspect 8: The feeding assembly of any one of the preceding aspects, further comprising a plurality of yarn packages disposed on respective yarn engagement elements of the plurality of yarn package engagement elements, wherein at least one yarn package of the plurality of yarn packages comprises a yarn end that extends to a heat setting apparatus.

Aspect 9: The feeding assembly of any one of aspects 3-8, further comprising at least one processor and a memory, wherein the memory has instructions thereon that, when executed by the at least one processor, cause the at least one processor to: activate the indicator; and cause the yarn package rack to rotate about 180 degrees.

Aspect 10: The feeding assembly of any one of the preceding aspects, further comprising a sensor that is configured to measure a quantity of yarn on a yarn package at a yarn package engagement element.

Aspect 11: The feeding assembly of any one of aspects 3-8, further comprising a user input device, wherein the user input device is communicatively coupled to the indicator to permit selective, remote activation of the indicator by an operator of the feeding assembly.

Aspect 12: A system comprising: a heat setting apparatus; and at least one feeding assembly as in any one of aspects 1-11.

Aspect 13: The system of aspect 12, further comprising a loading apparatus that is configured to place packages on the yarn package engagement elements.

Aspect 14: The system of aspect 13, wherein the loading apparatus is a gantry.

Aspect 15: The system of any one of aspects 12-14, wherein the at least one feeding assembly comprises at least six feeding assemblies.

Aspect 16: The system of aspect 15, wherein the at least one feeding assembly comprises at least twelve feeding assemblies.

Aspect 17: The system of any one of aspects 13-16, further comprising at least one processor and a memory, wherein the loading apparatus is positioned within a yarn package loading area, wherein each feeding assembly of the at least one feeding assembly comprises: an actuator that is configured to rotate the yarn package rack about the pivotal axis; and an indicator that is configured to activate prior to pivoting of the yarn package rack, wherein the at least one processor is communicatively coupled to the loading apparatus, the actuator of each feeding assembly, and the indicator of each feeding assembly, and wherein the memory has instructions that, when executed by the at least one processor, cause the at least one processor to: cause the loading apparatus to load a plurality of yarn packages on the first side of a yarn package rack; cause the yarn package rack to rotate about 180 degrees so that the first side of the yarn package rack is oriented in a yarn feed direction and the opposing second side of the yarn package rack is oriented toward the yarn package loading area; and cause the loading apparatus to load a second plurality of yarn packages on the second side of the yarn package rack.

Aspect 18: The system of aspect 17, wherein each feeding assembly comprises at least one sensor that is configured to measure a quantity of yarn on a yarn package at a yarn package engagement element, wherein the at least one processor is communicatively coupled to the at least one sensor of each feeding assembly, and wherein the memory has instructions that, when executed by the at least one processor, further cause the at least one processor to: receive signals from the at least one sensor of the feeding assembly of the yarn package rack; activate the indicator based upon the received signals; and cause the yarn package rack to rotate about 180 degrees so that the first side of the yarn package rack is oriented toward the yarn package loading area and the opposing second side of the yarn package rack is oriented in the yarn feed direction.

Aspect 19: The system of any one of aspects 11-18, wherein the at least one feeding assembly comprises a first feeding assembly and a second feeding assembly, wherein the first feeding assembly is positioned above the second feeding assembly.

Although the foregoing invention has been described in some detail by way of illustration and example for purposes of clarity of understanding, certain changes and modifications may be practiced within the scope of the appended claims.

What is claimed is:

1. A system comprising:

a heat setting apparatus; and at least one feeding assembly, each feeding assembly comprising:

a yarn package rack having a first side and an opposing second side; and a plurality of yarn package engagement elements on each of the first side and the second side of the yarn package rack, wherein the yarn package rack is configured to rotate about a pivotal axis to orient one of the first side or the second side toward a yarn package loading area and to orient the other of the first side or the second side toward a feed direction, and wherein the heat setting apparatus is configured to receive only one yarn at any given time from each feeding assembly of the at least one feeding assembly.

2. The system of claim 1, further comprising a loading apparatus that is configured to place packages on the yarn package engagement elements.

3. The system of claim 2, wherein the loading apparatus comprises a gantry.

4. The system of claim 2, further comprising at least one processor and a memory, wherein the loading apparatus is positioned within a yarn package loading area, wherein each feeding assembly of the at least one feeding assembly comprises:

an actuator that is configured to rotate the yarn package rack about the pivotal axis; and an indicator that is configured to activate prior to pivoting of the yarn package rack, wherein the at least one processor is communicatively coupled to the loading apparatus, the actuator of each feeding assembly, and the indicator of each feeding assembly, and wherein the memory has instructions that, when executed by the at least one processor, cause the at least one processor to:

cause the loading apparatus to load a plurality of yarn packages on the first side of a yarn package rack;

cause the yarn package rack to rotate about 180 degrees so that the first side of the yarn package rack is oriented in a yarn feed direction and the opposing second side of the yarn package rack is oriented toward the yarn package loading area; and cause the loading apparatus to load a second plurality of yarn packages on the second side of the yarn package rack.

5. The system of claim 4, wherein each feeding assembly comprises at least one sensor that is configured to measure a quantity of yarn on a yarn package at a yarn package engagement element, wherein the at least one processor is communicatively coupled to the at least one sensor of each feeding assembly, and wherein the memory has instructions that, when executed by the at least one processor, further cause the at least one processor to:

receive signals from the at least one sensor of the feeding assembly of the yarn package rack;

activate the indicator based upon the received signals; and cause the yarn package rack to rotate about 180 degrees so that the first side of the yarn package rack is oriented toward the yarn package loading area and the opposing second side of the yarn package rack is oriented in the yarn feed direction.

6. The system of claim 1, wherein the at least one feeding assembly comprises at least six feeding assemblies.

7. The system of claim 6, wherein the at least one feeding assembly comprises at least twelve feeding assemblies.

8. The system of claim 1, wherein the at least one feeding assembly comprises a first feeding assembly and a second feeding assembly, wherein the first feeding assembly is positioned above the second feeding assembly.

9. The system of claim 1, further comprising a plurality of yarn packages disposed on respective yarn engagement elements of the plurality of yarn package engagement elements of the at least one feeding assembly, wherein at least one yarn package of the plurality of yarn packages of the at least one feeding assembly comprises a yarn end that extends to the heat setting apparatus.

10. The system of claim 1, wherein the at least one feeding assembly further comprises an actuator that is configured to rotate the yarn package rack about the pivotal axis.

11. The system of claim 1, wherein the at least one feeding assembly further comprises an indicator that is configured to activate prior to pivoting of the yarn package rack.

12. The system of claim 11, wherein the indicator comprises at least one of a light or an audible alarm.

13. The system of claim 11, further comprising at least one processor and a memory, wherein the memory has instructions thereon that, when executed by the at least one processor, cause the at least one processor to:

activate the indicator; and cause the yarn package rack to rotate about the pivotal axis by about 180 degrees.

14. The system of claim 1, further comprising at least one processor, a memory in communication with the at least one processor, and a user input device in communication with the at least one processor, wherein the user input device is configured to permit a user to effect the rotation of the at least one feeding assembly.

15. The system of claim 1, wherein the at least one feeding assembly further comprises a base that is fixedly mount to a floor, wherein the yarn package rack is pivotably coupled to the base.

16. The system of claim 1, wherein the at least one feeding assembly is configured to support at least 680 lbs of yarn packages.

17. The system of claim 1, wherein the at least one feeding assembly further comprises a sensor that is configured to measure a quantity of yarn on a yarn package at a yarn package engagement element.

18. The system of claim 1, wherein the plurality of yarn package engagement elements of the at least one feeding assembly comprises eight yarn package engagement elements on each of the first side and the second side of the at least one yarn package rack.

19. The system of claim 1, further comprising a plurality of yarn packages, wherein each yarn package of the plurality of yarn packages is positioned on a respective yarn package engagement element of the plurality of yarn package engagement elements on the first side of the at least one yarn package rack.

20. The system of claim 19, wherein each yarn package of the plurality of yarn packages is spliced to at least one other yarn package of the plurality of yarn packages.

* * * * *